US010557678B2

(12) United States Patent
Barrett

(10) Patent No.: US 10,557,678 B2
(45) Date of Patent: Feb. 11, 2020

(54) MANUALLY OPERATED FIREARM SYSTEM

(71) Applicant: Ronnie Barrett, Murfreesboro, TN (US)

(72) Inventor: Ronnie Barrett, Murfreesboro, TN (US)

( * ) Notice: Subject to any disclaimer, the term of this patent is extended or adjusted under 35 U.S.C. 154(b) by 0 days.

(21) Appl. No.: 15/626,023

(22) Filed: Jun. 16, 2017

(65) Prior Publication Data

US 2018/0156558 A1 Jun. 7, 2018

Related U.S. Application Data

(63) Continuation of application No. 14/156,121, filed on Jan. 15, 2014, now abandoned.

(60) Provisional application No. 61/752,478, filed on Jan. 15, 2013.

(51) Int. Cl.
*F41A 17/42* (2006.01)

(52) U.S. Cl.
CPC ..... *F41A 17/42* (2013.01)

(58) Field of Classification Search
CPC ..... F41A 3/36; F41A 3/42; F41A 3/62; F41A 3/68; F41A 17/36
USPC ..... 42/69.01, 69.02, 16; 89/128, 143, 27.11
See application file for complete search history.

(56) References Cited

U.S. PATENT DOCUMENTS 3,155,004 A * 11/1964 Jennie ..... F41A 9/52 89/128
2018/0100714 A1* 4/2018 Borders ..... F41A 3/72

OTHER PUBLICATIONS

Trademark>Trademark Electronic Search System; http://tmsearch.uspto.gov/ (Year: 2018).*

* cited by examiner

*Primary Examiner* — J. Woodrow Eldred
(74) *Attorney, Agent, or Firm* — Ryan D. Levy; Patterson Intellectual Property Law, P.C.

(57) ABSTRACT

A bolt control device for causing the bolt of a firearm to be held in a retained position after each round is fired, the bolt control device capable of being manipulated by the user to also release and return the bolt to a firing position so that the firearm may be used to fire an additional round.

8 Claims, 8 Drawing Sheets

MANUALLY OPERATED FIREARM SYSTEM

CROSS-REFERENCES TO RELATED APPLICATIONS

This application claims benefit of U.S. patent application Ser. No. 14/156,121, filed Jan. 15, 2014, and entitled Manually Operated Firearm System which claimed priority to U.S. provisional patent application Ser. No. 61/752,478, filed Jan. 15, 2013 and entitled Manually Operated Firearm System, all of which is hereby incorporated by reference in its entirety.

BACKGROUND OF THE INVENTION

Technical Field

The present invention relates to a firearm system, particularly to a manually operated AR15 style firearm. In optional embodiments, a receiver for the firearm system may include one or more buttons or activators to manually release the bolt from a locked position. In yet further optional embodiments, the invention may include a retrofit kit so that an existing AR15-style firearm may be equipped to operate in a non-semi-automatic manner which may include the use of a device to fit to the existing bolt release.

Background of the Art

In the field of firearms, there are a multitude of different designs and types of rifles. One popular model includes what is known as the AR15 rifle. Other designations for similarly styled rifles are used, including both M4 and M16, referring to United States military variants, which may optionally include selective fire options. Additionally, the design is considered one of a modular nature and can include pistol variants as well.

Most AR15 firearms use a mechanism of operation which can be understood to be a direct gas impingement system. With such system, high pressure gas acts directly upon the bolt and the carrier containing the bolt, eliminating the need for a piston or separate gas cylinder. Upon firing an AR15 firearm, gas generated from the detonation of the powder moves through a gas port located in the top area of a barrel. Gas flows through the gas port into the gas block where it is directed into a gas tube, running generally about parallel with the barrel. The gas tube protrudes into the upper receiver of the AR15 firearm and extends into the bolt carrier key (also referred to as a "gas key") which directs gas into the bolt carrier. In turning down into the bolt carrier, the gas has space to expand within the carrier and forces the bolt carrier rearward toward the stock of the AR15-style firearm while forcing the bolt forward. This movement essentially unlocks the bolt from the forward position where the original detonation of the round took place. During the rearward movement of the carrier, a cam pin in the bolt necessitates that the bolt rotates and unlocks from the barrel extension of the barrel within the upper receiver. Thus, both the carrier and bolt move rearward together which extracts the empty cartridge prior to moving forward again, while a new round is chambered.

As previously mentioned, there exist further variants of AR15-style firearm that include piston operating systems. In such variants, a piston rod may be used that reciprocally moves between at least two positions. The piston can be coupled to the bolt carrier for movement of the bolt carrier from a first closed position to the open position, similarly to the movement obtained with a direct gas impingement operating system. In further optional embodiments, the piston is not attached to the bolt carrier but rather is simply in physical contact with the bolt carrier and thus can apply pressure to create movement. To function, gas generated from a detonated round flows through the gas port but instead of flowing down a gas tube as occurs with direct impingement operating systems, the gas forcefully acts on the face of the piston. This action drives the piston rearward and a rod or shaft in connection with the piston as well, which in turn applies abrupt force to the bolt carrier, having the rotatable bolt with cam pin. The bolt carrier moves rearward, the spent cartridge is ejected and the cycling commences similar to a direct impingement system, yet no gas directly acts upon the bolt and carrier.

The AR15 firearm versions in both of the above described variants generally functions in a semi-automatic matter. Otherwise stated, one trigger pull only results in the firing of one round of ammunition and the user can immediately pull the trigger again to fire another round. Different variants of the M16 rifle can function in three-round burst or full automatic firing.

What is particularly desired is a firearm that fires in a manually operated manner, wherein the user must perform some function between shots to allow the firearm to fire subsequently.

SUMMARY OF THE INVENTION

An optional aspect may include a firearm with a receiver, trigger, trigger guard, bolt carrier group, and bolt catch; with the bolt carrier group being in either a retained position or a firing position; a bolt control device connected to the bolt catch to maintain tension on the bolt catch to retain the bolt carrier group in a retained position; and a contact point on the device for manipulating the device by the user. In such optional aspect, a user may be able to manipulate the bolt control device and release the bolt carrier group from a retained position to a firing position.

In a further optional aspect, the firearm may further include a retention spring incorporated with the control arm of the bolt control device to maintain tension on the bolt catch to retain the bolt carrier group in the retained position after a round is fired.

In yet additional optional aspects, the invention may include a bolt control device with a first connection for connecting to a bolt catch for a firearm, a contact point for manipulating the device by the user; a retention spring for providing outward pressure on the bolt catch. Upon firing, the firearm's bolt carrier group is retained by the bolt catch and can be subsequently released by the user manipulating the contact point on the bolt control device.

In another optional aspect, the firearm may include the retention spring positioned between an underside of a paddle of the bolt catch and an upper receiver of a firearm. This may push the paddle outward and thus place the bolt catch in a position to lock a bolt carrier group into a retained position.

In further optional aspects, the bolt control device may be understood to adapt a firearm from semi-automatic to a manually loaded or operated arrangement.

As used herein, the term manually operated or manually loaded refers to a mode of operation of a firearm whereby after firing a round, a user must manipulate something other than the trigger on the firearm prior to firing another round. Otherwise stated, another trigger pull will not fire another round unless some prior action was taken. Additionally, as used herein, the term "semi-automatic" refers to a mode of operation of a firearm whereby after firing a round, a user must only initiate another pull of the firearm's trigger to fire another round. Otherwise stated, one trigger pull allows only one round to be shot from the firearm and the operator must manually perform an action to the rifles in order to load another cartridge, just as would be for a bolt action, lever action or pump firearm. Also, as used herein, "automatic" refers to a mode of operation of a firearm whereby after firing a round, the firearm fires one or more additional rounds without requiring the user to depress the trigger again or further manipulate the firearm.

Another optional aspect of the invention is a bolt control device comprising a drop in replacement for a standard bolt catch for an AR-15 firearm, the bolt catch device including a tension spring, contact portion, and a receiver connection channel. In such optional aspect, the bolt control device may be connected via a pin to a receiver of a firearm.

An optional aspect of the invention includes a bolt control device integrated into the firearm's receiver, the bolt control device operable while a user maintains a firing position on the firearm.

A further optional aspect of the invention includes a firearm with bolt control device with the bolt control device in communication with a bolt carrier group of the firearm, the bolt carrier group positionable between a retention position and a firing position, the bolt control device capable of releasing the bolt carrier group of the firearm from a retention position.

In other optional embodiments, the bolt control device may take the form of a hand guard button. Optionally, the bolt control device may be in a form of reverse trigger. Furthermore, the bolt control device may be integrated as a lever or a button into the receiver of the firearm.

In describing the various optional aspects of the present invention, the term "AR15-style firearm" may be used. This term is not to be considered or taken as limiting, but rather is intended to cover other variants and related firearm platforms which may include the AR-10 and similar larger-caliber variants as well as the various configurations of the M4. The AR15-style firearm and its variants, are not limited to but include the M16A2, M16A3, M16A4, the CAR-15 and its variants, the M4 and its variants, as well as the AR15 and its variants all of which are understood to be generally included with use of the term "AR15-style firearm." Furthermore, the invention may be used for a wide range of calibers for this rifle platform and those calibers should be considered in addition to the standard 0.223 Remington/5.56×45 mm round with possible calibers even including 50 Cal. BMG as well as other common military calibers. Additionally this can include other rounds as well such as the 22 lr up to the 50 Cal. BMG. As further discussed, the invention can also be used with other firearm designs, including popular designs like the Ruger 10-22.

As used herein the term "engage" means to interact with, interlock with, associate with or communicate with.

Further as used herein, the term "upper receiver" is used to be the portion of a rifle with which the barrel attaches. The upper receiver generally includes an ejection port as well as engagements for communicating with the lower receiver. The term "lower receiver" generally houses the trigger group.

The term "providing", and forms thereof, are used in a broad sense, and are referred to, but are not limited to, making available for use, enabling usage, giving, supplying, obtaining, getting hold of, acquiring, making ready for use, and/or placing into position ready for use.

Additionally, the term "firearm" is used to indicate a weapon from which bullets are discharged by way of gunpowder. "Rifle" is used to indicate a firearm that may be fired from the shoulder and includes rifling within the bore. "AR15/M16 style rifle" as used herein is defined above but also includes the relatively few variants which may include the same general components but in a pistol configuration. In other words, the invention may be applicable to a variety of pistol configurations and the use of the term "AR15-style firearm" includes those pistol configurations as well.

Aside from the structural and procedural arrangements set forth above, the invention could include a number of other arrangements, such as those explained hereinafter. It is to be understood, that both the foregoing description and the following description are exemplary.

The accompanying drawings are incorporated in and constitutes a part of this specification. The drawings illustrate optional embodiments of the invention and together with the description serve to explain some principles of the invention.

BRIEF DESCRIPTION OF THE DRAWING

Reference will now be made in detail to optional embodiments of the invention, examples of which are illustrated in the accompanying drawing. Whenever possible, the same reference numbers are used in the drawing and in the description referring to the same or like parts.

DETAILED DESCRIPTION

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

Generally, as used herein, a bolt control device is understood to be the hardware that can selectively control the position of a bolt carrier group of a firearm.

Figure 1:
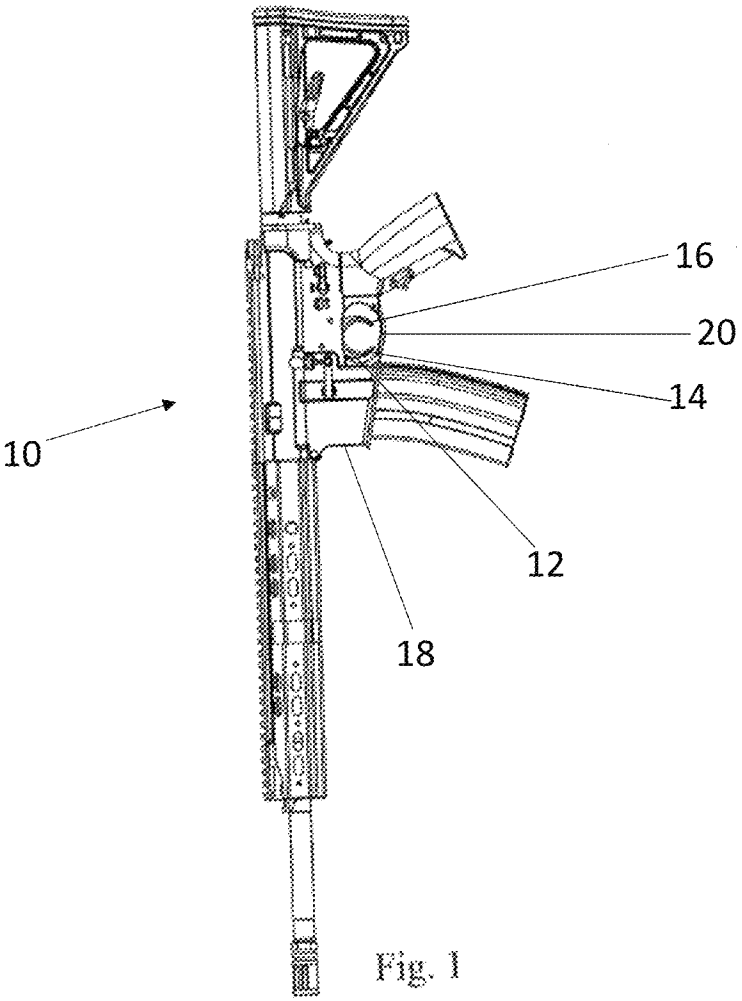
FIG. 1 is a sideview illustration of various locations for a bolt control device for a firearm.

FIG. 1. is an illustration of an optional embodiment of the firearm system 10 of the present invention detailing various locations in which a bolt control device 12 may be located. In some embodiments, the bolt control device 12 may generally embody a design having an appearance of a reverse trigger 14 forward of the normal trigger 16 used to operate the firearm 10. In such an arrangement, a user may fire the weapon with a pull of the trigger 16 with the bolt control device 12 retaining the bolt carrier group after each shot thereby requiring the user to press against the trigger-shape bolt control device 12 to release the bolt carrier group forward so that another shot may be fired. As such, the operation of the firearm system 10 in this manner would not constitute semi-automatic fire, instead being a manually operated single shot arrangement as the bolt would not automatically reload and return to a firing position after the round had been fired. By positioning the bolt control device 12 in such location forward of the trigger, a user may be able to initiate the reloading process by release the bolt to the firing position so that the weapon may be fired again.

Figure 2:
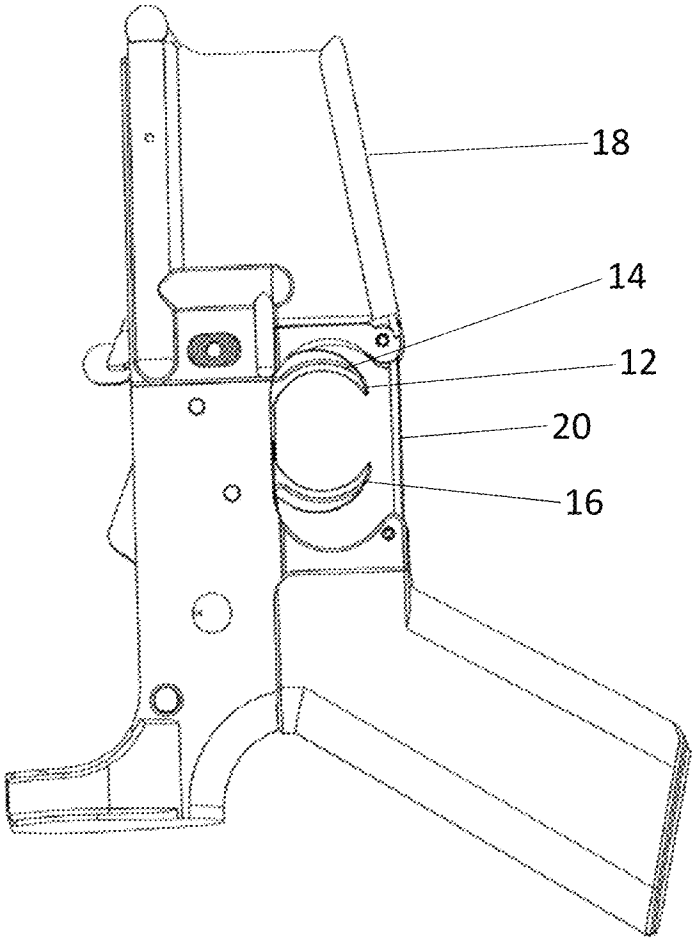
FIG. 2 is an illustration of an optional embodiment of the lower receiver for the firearm system with the bolt control device having a shape of a reverse trigger.

In optional embodiments, the lower receiver 18 for the firearm system 10 may include an additional opening with the bolt control device 12 having a shape of a reverse trigger 14. Such optional embodiments is illustrated in FIG. 2. As such the parts may integrate within the lower receiver 18 and coordinate with the existing hardware to maintain the position of the bolt carrier group. The bolt control device 12 having a reverse trigger type shape may be in communication with the bolt catch as the bolt catch is already utilized to maintain the bolt character group in a retained position after a magazine is emptied. Here, the bolt catch in optional embodiments could operate so as to retain the bolt carrier group in the retained position after every shot and not just after the magazine is emptied.

Figure 3:
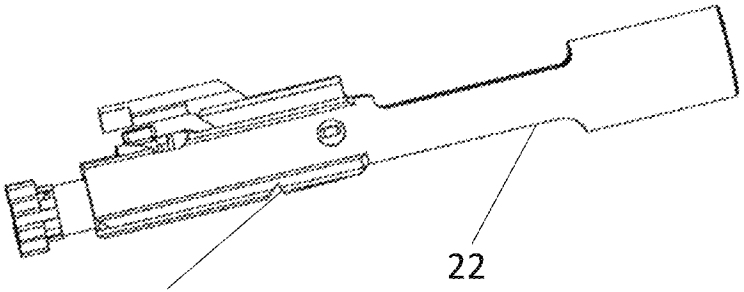
FIG. 3 is an illustration of an optional embodiment of the bolt carrier group including a notch.
Figure 4:
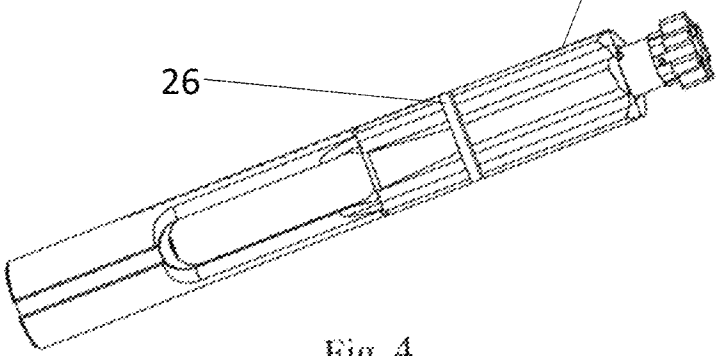
FIG. 4 is an illustration of an optional embodiment of the bolt carrier group including a notch.

In yet further optional embodiments, a bolt control device 12 in position within the trigger guard 20 of a firearm may communicate with the bolt or bolt carrier group 22 separate from the bolt catch for the firearm. As such, the bolt catch as exists on a variety of different AR15-type firearms would be separate from the mechanical elements to maintain the firearm in a single shot system. In yet further optional embodiments, the bolt carrier group 22 for a firearm may include a notch or catch location point whereby the bolt carrier group 22 is modified so as to respond and communicate with the bolt control device 12 in its various forms. Such optional embodiment is indicated with FIG. 3 and FIG. 4. As such this optional embodiment may include a reverse trigger style bolt control device 12 communicating directly with a bolt carrier group 22 engaging a notch or catch point 26 on the bolt carrier group 22 to maintain it in a retained position after a shot has been fired.

In yet further optional embodiments, the bolt control device 12 may be located on various locations on the body of the receiver of the firearm 10. Generally, such optional embodiments may include the bolt control device 12 as a lever or button 28 so that a user may be able to quickly access the bolt control device 12 and be able to put the weapon in a condition to allow for a subsequent round to be fired. As the previous optional embodiment described the bolt control device 12 as being operated by the same hand that pulls the trigger 16 to fire the firearm 10 there may also be other locations on the receiver 18 that may also be manipulated by the firing hand of the user. For example, with an AR15-style firearm, a bolt control device 12 could optionally be located in front of the magazine release as such location would allow for a user to use their trigger finger to release the bolt carrier group from a retained position as well.

Figure 5:
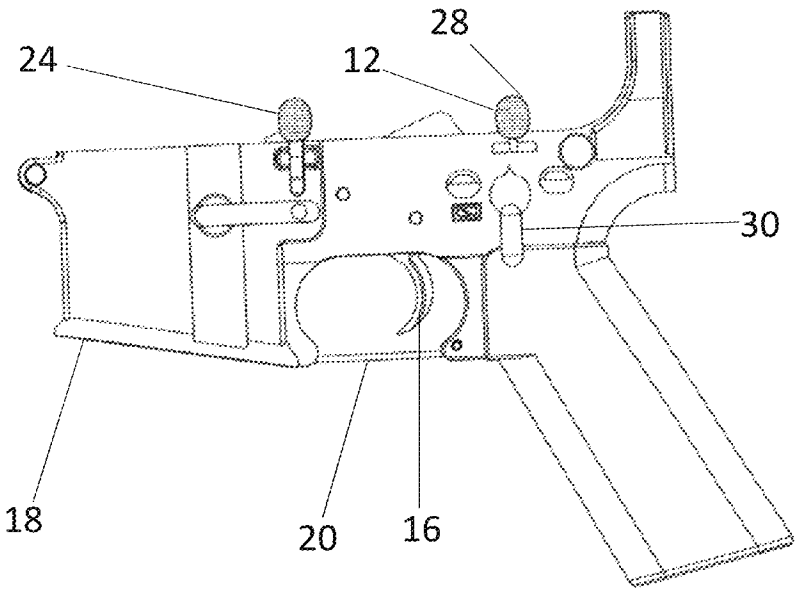
FIG. 5 is an illustration of an optional embodiment of the bolt control device as a small lever located to control the position of the bolt or bolt carrier group via a user's firing hand thumb.
Figure 6:
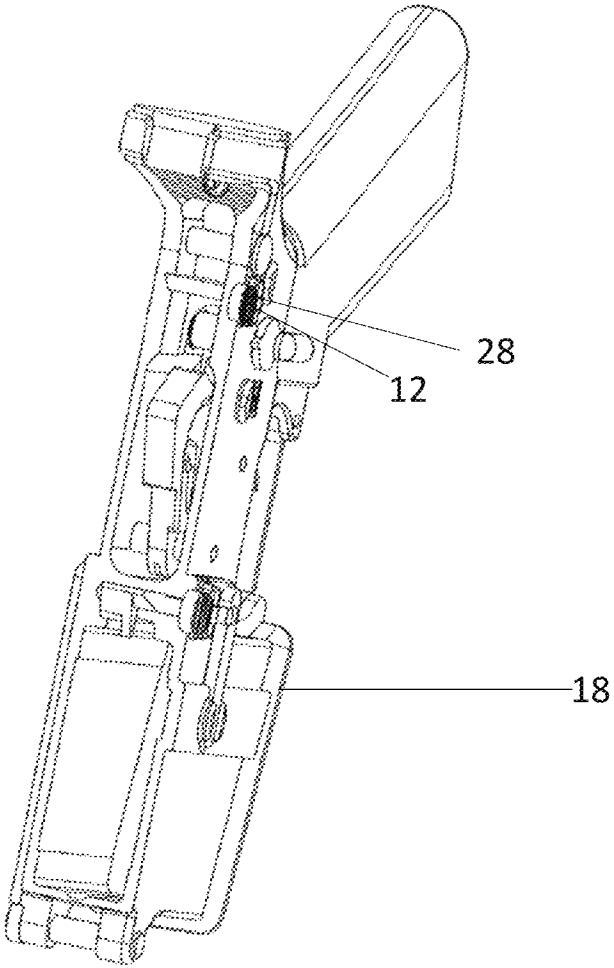
FIG. 6 is an illustration of an optional embodiment of the bolt control device located to control the position of the bolt or bolt carrier group via a user's firing hand thumb.

In further optional embodiments, especially embodiments where the bolt control device 12 is not in direct communication with the bolt catch for an AR15-style firearm, the bolt control device could be located closer to the rear of the receiver 18 in a location where a user may use the thumb of their firing hand to release the bolt forward. While the safety 30 of most AR15-style firearms is located in a position to be operated by the thumb of the firing hand of a user, there still exists the possibility that a button or small lever 28 could be located in a similar position so as to control the position of the bolt or bolt carrier group via the user's firing hand thumb. Such optional embodiments are illustrated in FIG. 5 and FIG. 6. Obviously in some optional embodiments this would require a different style of receiver to allow for the openings, buttons, and/or levers to be positioned so as to allow the mechanics of the bolt control device 12 to function. In such optional embodiments, the bolt control device 12 may also utilize spring tension to correlate with a catch or notch on the bolt carrier group to maintain the bolt carrier group not in a firing position.

Yet furthermore in optional embodiments, a bolt control device 12 may be utilized so that a user may use their support hand to activate the bolt control device 12 and thus push the bolt carrier group back into a firing position. In some optional embodiments, a bolt control device 12 may be located on the handguard of the firearm to be operated by the user's support hand. In such optional embodiments, a user may manipulate a button, lever, or other type of bolt control device 12 design on the handguard which thereby could release the bolt to a firing position. In some optional embodiments of the handguard style bolt control device, the bolt control device may communicate with the bolt catch as presently exists on a variety of different AR platforms. In other optional embodiments, the bolt control device may function independently of the bolt catch and thus retain the bolt carrier group out of a firing position independent of the bolt catch.

In some optional embodiments, the bolt control device 12 may be on the top portion of the handguard so a user could use their thumb, with such design being considered ambidextrous so that a user could use their left hand or right hand depending on how they fire the firearm. Furthermore, there may be optional embodiments whereby the bolt control device may be convertible between a position on the left side of the firearm or the right side of the firearm at the handguard so as to allow a user to set up the firearm preferable for their style of shooting.

Figure 7:
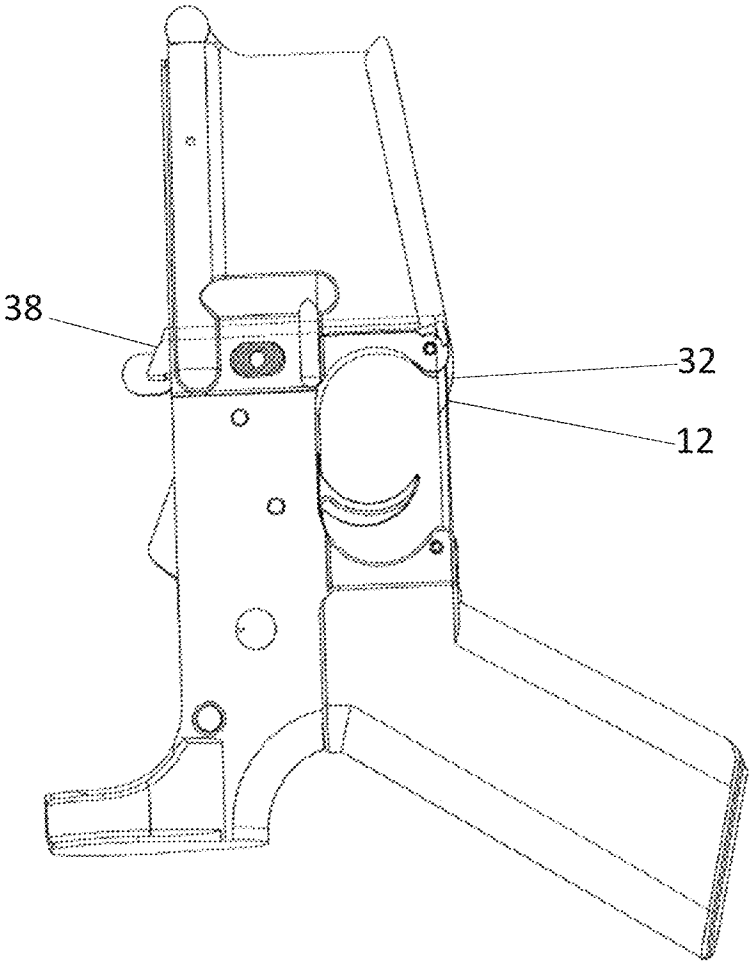
FIG. 7 is an illustration of an optional embodiment of the bolt control device incorporating the trigger guard to be operated by the user.
Figure 8:
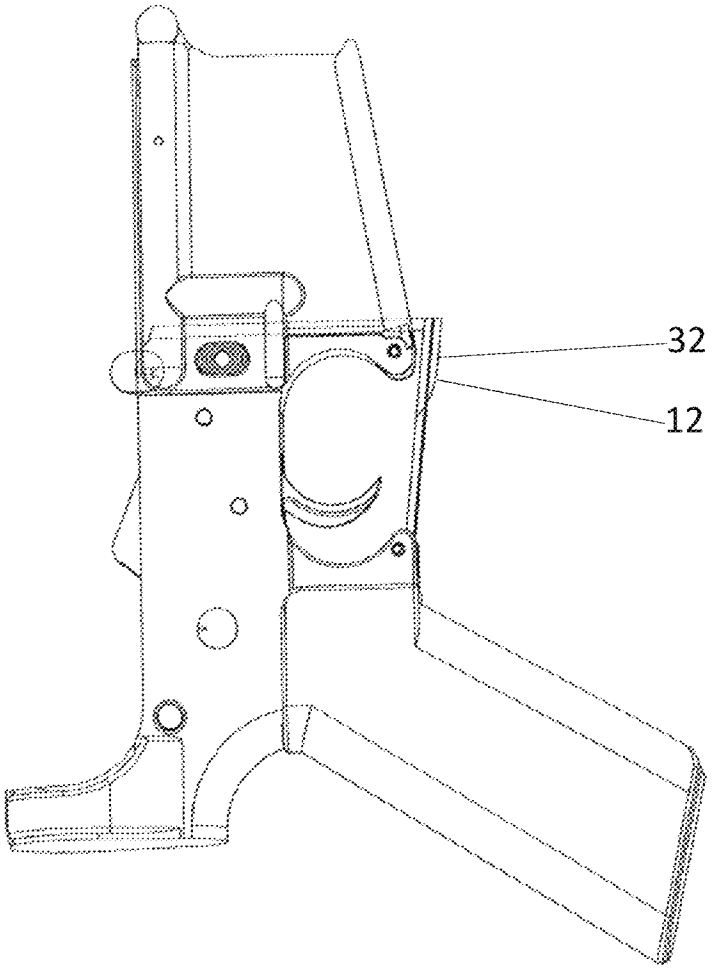
FIG. 8 is an illustration of an optional embodiment of the bolt control device incorporating the trigger guard to be operated by the user.

In yet further optional embodiments, the bolt control device 12 may be part of or located at the bottom portion of the trigger guard 20. Somewhat similar to how certain handguns provide a magazine release located in this general area, a lever 32 could be positioned here at the lower portion of the trigger guard 20 for control of the bolt carrier group. In further optional embodiments, such design may be of an ambidextrous nature and provide levers 32 that work on both sides of the lower portion of the trigger guard 20 so that a left-handed or right-handed user could operate the firearm in a single shot manner. FIGS. 7 and 8 illustrate this optional embodiment of the bolt control device.

While the disclosure has described a firing position and a retained position with regard to the bolt carrier group, one can understand the firing position to be a position whereby the bolt is positioned so that a trigger pull would allow for a round to be fired. The retained position or retention position generally refers to the bolt carrier group and bolt held in the rearward position as is generally done with the standard bolt catch though in optional embodiments "retained position" or "retention position" may be understood as being more broad. For purposes of this disclosure "retained position" or "retention position" means any position in which the bolt is kept out of a firing position whereby a user would have to use the bolt control device to push the bolt and bolt carrier group into a firing position. For example, optional embodiments of the invention could include a firearm system where after a shot is fired the bolt carrier group cycles and is maintained only slightly out of the firing position with another round at least partially chambered. In looking through an injection port of this optional embodiment of the firearm system one would see the bolt in a fairly forward position though not all the way in a firing position. In this position, the firearm would not yet fire as the bolt and bolt carrier group are not in a firing position, though is not held in the most rearward position as is understood in the prior art. As such, the bolt control device could be used to provide a relatively slight push, somewhat similar to the action of the forward assist as found on most AR15-style firearms. Thus, these optional embodiments of the firearm system would include the bolt control device 12 functioning to provide forward pressure on the bolt or bolt carrier group to a firing position. This may also be understood as not being semi-automatic as a separate action would be required by the user prior to being able to fire another round. Regardless, one can understand "retained position" or "retention position" as any position of the bolt or bolt carrier, at least slightly rearward, and not in a position to allow for firing.

Optional embodiments of the bolt control device may be utilized with firearm systems specifically designed for integration of the bolt control device. Otherwise stated, in some optional embodiments the receiver may be designed to have an opening, indentation, or space specifically provided for the bolt control device 12. In some optional embodiments, a firearm system 10 may come from the factory with the bolt control device integrated into the firearm. In some of the optional embodiments discussed, such as the reverse trigger style, one would understand that additional openings or modifications are necessary to the receiver so as to allow for such mechanical components to be part of the firearm.

Figure 9:
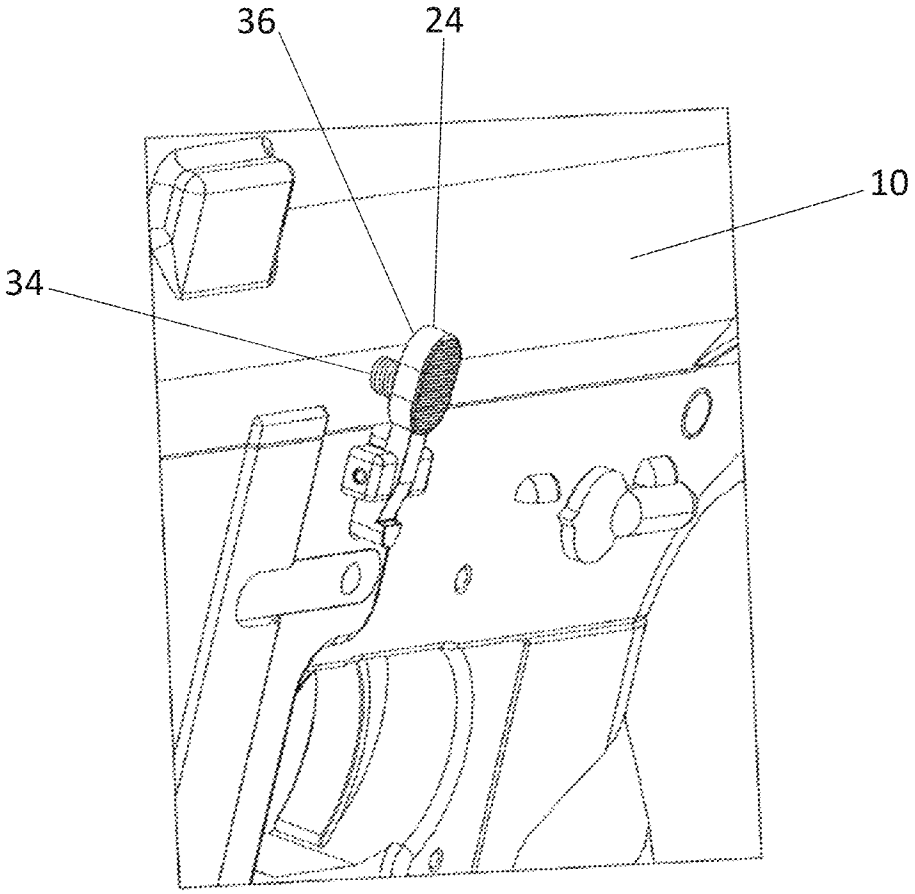
FIG. 9 is an illustration of an optional embodiment of a spring element positioned between the back side of the paddle of the bolt catch and the firearm.

In yet further optional embodiments, the bolt control device may be a component that attaches to the bolt catch and exists generally on the exterior of the receiver. While there do exist devices currently that connect the bolt catch and allow a user to manipulate the bolt catch with a right handed user's trigger finger, the existing devices do not allow or provide for the retention of the bolt carrier group or bolt after every shot is fired. Optional embodiments of the bolt control device for the firearm system advantageously provide a spring element that is incorporated with a lever that engages the bolt catch of a firearm. Generally speaking, in this embodiment of the bolt control device 12, the bolt control device 12 affixes to the paddle of the bolt catch on the AR15-style firearm and extends a lever through the trigger guard to be operated by the user. Additionally, a spring element 34 may be positioned between the back side of the paddle 36 of the bolt catch 24 and the firearm 10 so as to maintain outward pressure on the paddle 36 of the bolt catch 24. Such spring element 34 is illustrated in FIG. 9. By doing so, the firearm will lock in a retained position after each shot is fired due to the outward pressure on the paddle 36 of the bolt catch 24. The user then would be able to release the bolt carrier group and allow it to return to a firing position.

In optional embodiments, the bolt control device 12 may affix to both sides of the paddle 36 of a standard bolt catch 24 for an AR15-style firearm with a spring element 34 positioned on the back side of the paddle 36 of the bolt catch 24 that remains at least in partial compression against the receiver of firearm 10.

Such design can be considered a retrofit style kit as it may work with an existing AR15-type firearm. In yet further optional embodiments, a similar type of device may be utilized that can entirely replace the bolt catch of an existing AR-type firearm. In such arrangement, the bolt control device may be integrated with the bolt catch and likely include a spring element or the like so as to provide tension and thus maintain the bolt carrier group in the retained position after a round has been fired.

Additionally, while the bolt control device has been described most particularly with respect to an AR15-type firearm, it could be incorporated with virtually any semi-automatic firearm to preclude semi-automatic fire while allowing single-shot, manual operation. This includes the use of a bolt control device with, but not limited to, virtually any assault rifle, battle rifle, semi-automatic pistol, machine-gun, sub-machinegun, semi-automatic rifle, and semiautomatic shotgun. Some examples include, but are in no way limited to the following firearms and their variants: AK; AMD-65; SCAR; M1; M14; FN FAL; G3; G36; galil; bullpups including both Steyr and Tavor; various Barrett rifles; HK submachineguns; Uzis; shotguns include Remington 1100s and VersaMaxes, Benellis, FN SLPs, Mossberg 930s, Winchesters, and CZs; and 22 LR firearms include the Ruger 10/22, S&W M&P15-22, Mossberg 702 and as well as various AR conversions.

In yet further optional embodiments, the bolt control device could be used with various semiautomatic handguns. Obviously, in most of these optional embodiments, there would not be options for the bolt control device to be present on a handguard. However, the bolt control device in these embodiments could be positioned differently so as to allow for activation by the user's strong hand, weak hand, or both. For example, this could allow for a lever or button on the forward side of the frame's left side so that a right-handed individual could activate the bolt control device with their weak thumb. In some optional embodiments, the bolt control device when used on a handgun, could be positioned so as to be ambidextrous. This can include, but is not limited to the use of the bolt control device on handguns manufactured by Sig Sauer; Glock; Smith & Wesson; Springfield; Ruger; Browning; C-Z; FN; Walther; Taurus; various 1911s; and HK.

Furthermore, sizes of various structural parts and materials used to make the above mentioned components are illustrative and exemplary only, and persons of ordinary skill in the art would recognize that these sizes and materials can be changed as necessary to produce different results or different desired characteristics.

It would become apparent to those skilled in the art that various modifications and variations can be made to the structure and methodology of the present invention. Thus, it should be understood that the invention is not limited to the examples discussed in the specification. Rather, the present invention is intended to cover modifications and variations.

The invention claimed is:

1. A firearm comprising:

a receiver, trigger, trigger guard, bolt carrier group, a barrel, and bolt catch;

the bolt carrier group positionable in a retained position;

the bolt carrier group positionable in a firing position;

the bolt catch having a paddle with a backside and connected to the receiver; and a bolt control device including a spring element between the backside of the paddle of the bolt catch and the receiver, the spring element maintaining outward pressure on the backside of the paddle of the bolt catch;

wherein the bolt control device retains the bolt carrier group after each time the firearm is fired.

2. The firearm of claim 1 where in the spring element of claim 1 is affixed to the back side of the paddle of the bolt catch.

3. The firearm of claim 1 wherein the spring element of claim 1 is in contact with the backside of the paddle of the bolt catch and the receiver of the firearm.

4. A firearm comprising:

a receiver, trigger, trigger guard, bolt carrier group, and reverse trigger bolt control device;

the bolt carrier group being in either a retained position or a firing position and having a notch for engaging the reverse trigger bolt control device; and the receiver having a first hole to receive the trigger within the trigger guard and the receiver having a second hold for receiving the reverse trigger bolt control device within the trigger guard.

5. The firearm of claim 4 wherein the reverse trigger bolt control device is within the trigger guard and oriented opposite to the trigger.

6. The firearm of claim 4 wherein the reverse trigger bolt control device is operable to engage the notch on the bolt carrier group and disengage the notch on the bolt carrier group.

7. A firearm comprising:

a receiver, trigger, trigger guard, bolt carrier group, bolt catch; and bolt control device;

the bolt carrier group positionable in a retained position;

the bolt carrier group positionable in a firing position;

the bolt control device comprising part of the trigger guard and in communication with the bolt catch of the firearm; wherein the bolt catch retains the bolt carrier group after each time the firearm is fired and downward pressure on the bolt control device comprising part of the trigger guard allows the bolt carrier group to move into a firing position.

8. The firearm of claim 7 where the bolt control device comprising part of the trigger guard comprises levers for ambidextrous manipulation.

* * * * *